United States Patent [19]

Quinn

[11] 4,231,119

[45] Nov. 4, 1980

[54] ADJUSTABLE APRON OF VINYL LAMINATE

[76] Inventor: Daniel P. Quinn, 4802 Krueger Ave., Parma, Ohio 44134

[21] Appl. No.: 68,506

[22] Filed: Aug. 22, 1979

[51] Int. Cl.[3] ..... A41B 13/10

[52] U.S. Cl. ..... 2/48; 2/52

[58] Field of Search ..... 2/48–52

[56] References Cited

U.S. PATENT DOCUMENTS

| | | | |
|---|---|---|---|
| 2,344,845 | 3/1944 | Baldechwieler | 2/48 |
| 3,801,985 | 4/1974 | Batt | 2/48 |

FOREIGN PATENT DOCUMENTS

| | | | |
|---|---|---|---|
| 1531545 | 11/1978 | United Kingdom | 2/52 |

*Primary Examiner*—Doris L. Troutman

*Attorney, Agent, or Firm*—Alfred D. Lobo

[57] ABSTRACT

An adjustable apron is disclosed which is made of three separate pieces of vinyl fabric, namely a body member and two identical crescent-shaped arm cut-out strips. The vinyl fabric is a soft and flexible vinyl laminate formed by bonding poly(vinyl chloride) to a woven cotton cloth. The apron is so constructed as to provide a neck loop which is adjustable for wearers having a wide variety of body shapes and sizes. The apron is provided with a pair of arcuate arm cut-outs having seams each of which has a critical radius in the range from 25 cm to about 40 cm. With this radius, when the apron is worn, with its vinyl surface exteriorly disposed, the cotton cloth inner surface of the laminate frictionally engages the clothing of the wearer and provides a good fit with a relatively large contact surface which allows the wearer to secure the apron in a comfortable position on his body. The arm cut-outs are (i) dimensioned so as to allow frictionally restricted, flat arcuate movement of a laminar cotton tape slidably and snugly held between opposed cotton inner surfaces of arcuate hem passages at the arm cut-outs, frictional engagement of the tape in the passages allowing the apron to be held in position on the wearer; (ii) constructed to provide a hidden arcuate reinforcing seam against which the neck loop rubs, and is stressed, without rubbing against the stitches of the seam; and (iii) in use, when the ends of the tape are tensioned and tied behind the body of the wearer, at his waist, the body member of the apron does not become gathered and bunched together to form stress-creases in the vinyl in the areas where the tape exits from the body member.

1 Claim, 4 Drawing Figures

ADJUSTABLE APRON OF VINYL LAMINATE

BACKGROUND OF THE INVENTION

Aprons have been formed from a wide variety of materials, the function of the material being to absorb liquid or soiling substances which may be splashed upon the apron, or to repel liquid, solid or other materials which might, but for the apron, soil the garment of the person wearing the apron. Accordingly, aprons are made of woven cotton cloth, paper, non-woven natural and synthetic materials, and the like. Some of the aprons are disposable, that is, meant to be discarded when soiled. The material from which the apron, whether disposable or not, is to be constructed, depends upon the particular requirements of its wearer. If the apron is to protect the garments of the wearer from a wide variety of soiling substances it is expected to be constructed from a suitably durable material; if the wearer is to be protected against acid and the like, the material of the apron is desirably made from acid-resistant material such as a synthetic resinous material, for example, a polyolefin, polyamide, and the like. Commonly preferred materials are polyethylene, poly(vinyl chloride), and nylon, but these materials are relatively more expensive than paper or cloth and therefore aprons made of such materials are not disposable. In fact, they are expected to be long-lived since they are easy to clean and durable. However, synthetic resinous materials in general, are highly susceptible to the propagation of slits or punctures however they are initiated. When a non-woven material such as a vinyl laminate (referred to herein as "vinyl" for brevity) is sewn, the piercing of the needle punctures and inherently weakens the vinyl so that stress tends to propagate the punctures. Thus, when a neck loop and waist-tying straps are sewn to a vinyl body member of an apron, as is conventionally done, repeated use of the apron causes the straps to tear away from the body member of the apron.

The vinyl laminate of non-woven poly(vinyl chloride) bonded to a woven cotton cloth fabric is a relatively new material which has been found peculiarly well-suited for the construction of an easy-to-care-for and durable apron. However, because of the relatively high cost of purchasing the material, and fabricating an apron from it, it is essential that the apron be adjustable, that is, it must fit a wide variety of body shapes and sizes. By "a wide variety of body shapes and sizes" I refer to male and female persons in the range from about 5 ft to about 6 ft tall, and weighing in the range from about 100 lb to about 200 lb. By "fit" I mean (i) that the apron must be worn comfortably by the wearer, supported in large part by the pelvic region of the body of the wearer, and (ii) the apron, when worn, must stay in position on the wearer without having to be constantly re-tied because the apron "rides up" or "rides down" due to its proclivity to slide without exertion of a force, on its straps or drawstrings, whether the apron is adjustable or not, and whether a single continuous drawstring or plural drawstrings are used.

Aprons are said to have been used since the beginning of recorded history, and because of their essential simplicity, there have been few improvements over the centuries which can be adjudged novel in this art. Such novelty as there is, usually derives from the special conditions under which the apron is to be used, and/or the particular materials from which it is constructed. In particular, adjustable aprons (also referred to as adjustable bib aprons) having an adjustable neck loop provided by a continuous tape or drawstring which serves both as a neck loop and waist-tying straps, and in which the draw string passes through folded corner portions of the body member of the apron are well known, being disclosed for example in U.S. Pat. Nos. 1,674,904 to Kemp, and 3,801,985 to Batt.

Kemp discloses an apron made from cheap, semi-stiff material in which open hems are provided by folding over and stitching extensions of the apron to form arm cut-outs. There is no provision for negating the propagation of punctures caused by stitching a material unknown at the time. A continuous drawstring provides an adjustable neck loop and also waist-tying straps. The open hems so formed, though arcuate, do not provide any reinforcing for wear resistance, nor is there any teaching as to the desirability of limited movement of the drawstring in the open hem, which limited movement is controlled by frictional engagement of the drawstring in the hem.

Batt discloses gluing an apron, rather than sewing it, to circumvent the problem of the propagation of punctures caused by sewing the material. In addition, for strength, Batt discloses straight-edged arm cut-outs deliberately so designed as to allow material in areas of the apron near where the strip exits from the body member to bunch up and form stress creases, so as to provide additional reinforcement against tearing of the material. Such bunching is deleterious to the vinyl laminate material used in the fabrication of my apron. Moreover, Batt is unconcerned with, and does not teach the desirability of obtaining substantial friction in the hem of the arm cut-out, between the continuous tape and the interior surfaces of the hem. Neither of the constructions of the prior art aprons meets the performance requirements of the expanded vinyl apron of this invention as will be be fully described hereinafter.

SUMMARY OF THE INVENTION

The apron of this invention is necessarily fabricated from three separate laminar pieces of a specific material, namely a soft, flexible laminate of poly(vinyl chloride) and woven cotton cloth known commercially as "expanded vinyl" in which punctures are easily propagated under stress. The three pieces include a body member and two identical quarter-ring-shaped (or crescent-shaped) arm cut-out strips (hereafter "arm cut-out strips" for brevity) which are sewn to the body member, on opposite sides thereof, so as to provide a surprisingly strong and easy to manufacture, hem. In each hem, cloth-to-cloth contact is obtained between a continuous cotton tape, held flatly therein, and the inner surfaces of the arm cut-out strips. Each hem is formed by sewing an arm cut-out strip to the body member of the apron so as to form a hidden arcuate reinforcing seam. This seam, which defines an edge of an arm cut-out, has a critical radius in the range from 25 cm to 40 cm, which radius is such that (i) the lower portion of the body member of the apron adjustably fits, and, an area of the body member in the waist region, rests upon the pelvis of the wearer, (ii) the continuous flat cotton tape is frictionally engaged so as to allow limited flat arcuate movement of the tape in the hems of the arm cut-outs, and (iii) the body member of the apron, when tied at the waist of the wearer, does not become gathered and bunched together so as to develop stress creases in the areas where the tape exits from the body member as tension is put on the tape. In use, tension on the ends of the continuous tape exerts a force which forces the upper edge of the tape against edge-rubbing surfaces of the reinforcing seams. The tape does not rub against the stitches which form the seam, thus forming an apron of simple construction but exceptional strength.

BRIEF DESCRIPTION OF THE DRAWING

The construction and advantages of the apron of this invention will be understood more fully and clearly from the following description taken in connection with the appended drawing in which.

DETAILED DESCRIPTION OF A PREFERRED EMBODIMENT OF THE INVENTION

In the following detailed description, the term "arm cut-outs" is used to refer to those arcuate portions of the apron which lie below the shoulder of its wearer. The term "arm cut-out strip" refers specifically to each of two identical quarter-ring-shaped, flat, strips which are sewn to the body member, and which strips together with the body member, define the "arm cut-outs".

Figure 2:
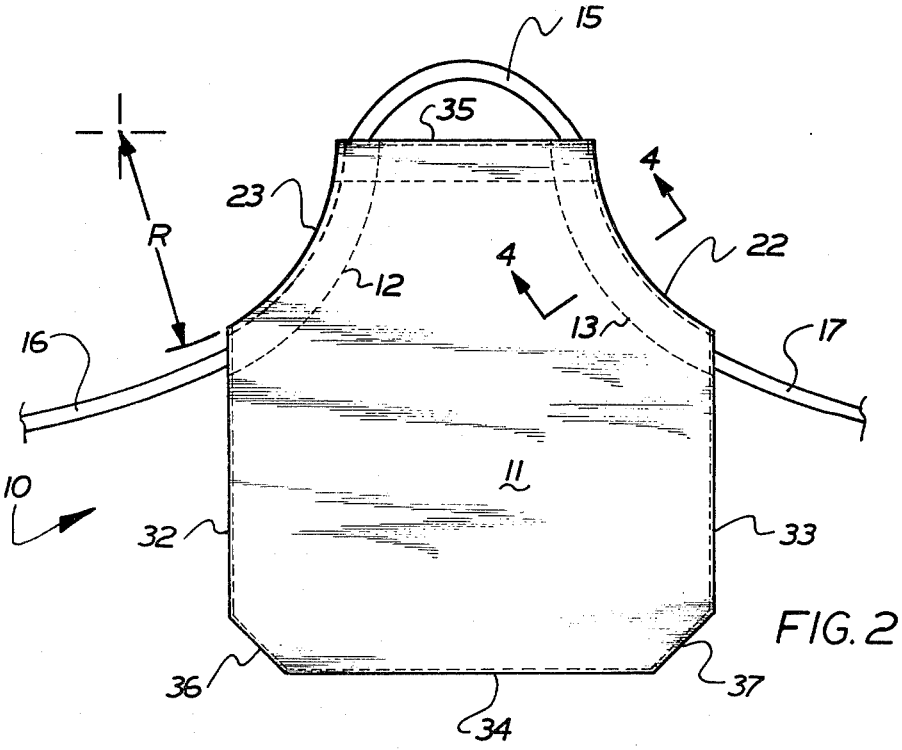
FIG. 2 is a front elevational view of the apron showing a continuous tape through hems in the arm cut-outs, for adjustably positioning the apron.
Figure 1:
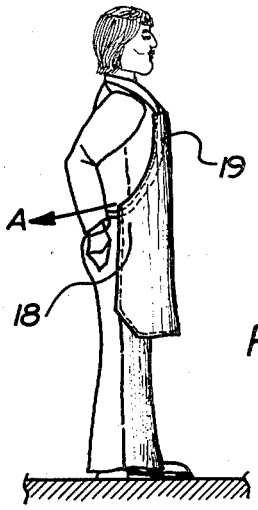
FIG. 1 is a side elevational view diagrammatically illustrating the apron in use, and particularly, the unbunched area where the tape exits the body member of the apron.

Referring to FIGS. 1 and 2, there is illustrated use of the vinyl apron indicated generally by reference numeral 10, comprising a body member 11 and a pair of separate identical arm cut-out strips 12 and 13 which define arm cut-outs. All three pieces of vinyl laminate from which the apron 10 is fabricated are cut from less than one square yard (1 sq yd) of a vinyl laminate consisting of a woven cotton cloth bonded to non-porous poly(vinyl chloride) commercially referred to as expanded vinyl chloride (hereinafter referred to as "vinyl" for brevity), in a weight range from about 16 to 26 ounces per square yard (oz/yd$^2$). In this weight range the vinyl laminate is soft and flexible, easy to clean and highly durable so long as it is not perforated, punctured or cut in such a way that an opening in the vinyl surface is allowed to propagate. The apron 10 is held in place on the body of the wearer by means of a single continuous flat tape 14 which serves both as a neck loop 15 and as waist-tying elements 16 and 17 to be tied by a knot behind the wearer. The tape 14 is preferably of woven cotton but may be a woven synthetic resin fiber or a non-woven strip. A cotton tape provides optimum frictional properties and is less damaging due to its rubbing action during use of the apron, than synthetic resinous materials. The directional arrow A in FIG. 1 illustrates tension on the tape 14 when it is looped around the neck of the wearer and pulled around behind the body at the waist, to be tied. As seen in FIG. 1, the flexible material of the body member of the apron does not gather or bunch together in the areas 18 and 19, where the tape exits from the body member, as the tape is tensioned so as to exert a wrap-around force on the body member of the apron. Further, as is seen in FIGS. 1 and 2, the tape stays flat as it exits from the body member of the apron.

Figure 3:
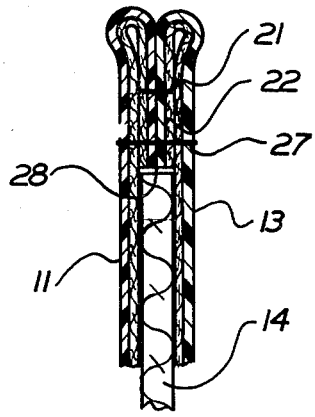
FIG. 3 is an enlarged detail section showing the manner in which each quarter-ring shaped arm cut-out strip is sewn to the body member.
Figure 3:
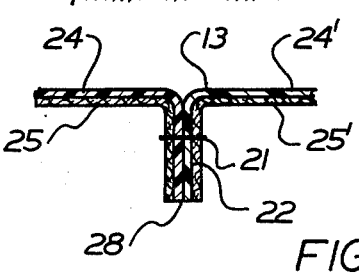

Referring now to FIG. 3 there is diagrammatically illustrated a portion of the body member 11 where it is sewn to arcuate cut-out strip 12 by a continuous first top-stitch 21 to form an arcuate hidden reinforcing seam 22. Another similar reinforcing seam 23 is formed at the oppositely disposed arm cut-out. When stitched as illustrated, vinyl surfaces 24 and 24' of the body member and arcuate arm cut-out strip respectively are compressed in abutting relationship between the cotton fabric surfaces 25 and 25' in which cotton fabric the stitches hold fast, thus limiting the propagation of the holes punctured in the vinyl.

Figure 4:
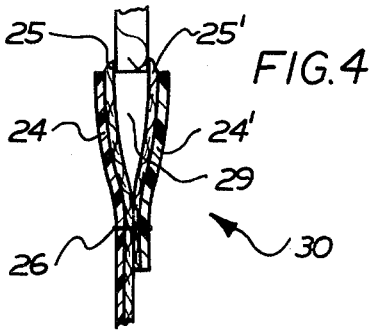
FIG. 4 is an enlarged vertical section taken generally along the line 4—4 of FIG. 2, with a portion broken away, showing the continuous tape held flat, snugly and slidably within the passage formed by the hem of an arm cut-out.

Referring now to FIG. 4 it is seen that seam 22 is hidden when the arm cut-out strip 13 is turned down upon and sewn with a second top-stitch 26, to body member 11 to form a hem, indicated generally by reference numeral 30. Another hem 31 is similarly formed with arm cut-out strip 12. The cotton fabric surfaces 25 and 25' are compressed in abutting relationship between the vinyl surfaces 24 and 24' by the top-stitch 26. It will now be recognized that the punctures caused in the vinyl surfaces by stitching the second top-stitch 26 are not restrained from being further propagated, as in the first top-stitch 21, yet the second top-stitch has more than adequate strength, since there is very little stress exerted by the tension of tape 14 on the top-stitch 26 when the apron is in use. As will be apparent, the tension of tape 14 is exerted against the hidden reinforcing seam 22, which is further reinforced by a third top-stitch 27. The third top-stitch 27 secures hidden seam 22 tightly between the arm cut-out strip 13 and the body member 11 forming an edge-rubbing surface 28 (so termed because the upper edge of tape 14 rubs against it), against which the upper edge of tape 14 rubs when the apron is adjusted for use, and against which the tape is stressed when the apron is actually in use.

The edge-rubbing surface 28 is formed by the combined edges of the vinyl surfaces 24 and 24' and the cotton fabric edges 25 and 24'. The upper edge of tape 14 is thus prevented from rubbing against a single thickness of cotton fabric surface, as the tape's edge would be, if the body member 11 was simply folded over and top-stitched to itself. The edge-rubbing surface 28 also provides frictional engagement so that, in combination with the frictional engagement provided by cotton fabric surfaces 25 and 25' against the sides of the tape, the tape is held flatly, arcuately and snugly within passage 29. Thus, though the tape allows adjustabillity of the apron on the body of the wearer, it is not loosely adjustable, but requires the exertion of a substantial force of at least one pound (1 lb force). The tape 14 is frictionally snugly engaged in each hem for flat arcuate movement, only upon exertion of the force. A simple test demonstrating the frictional engagement is as follows: the apron 10 can be held up by neck loop without "riding down" the tape because of the weight of the apron. Further, with this construction, the tape 14 is fixedly secured in position in the passage 29 when the apron is in use, so that the apron will neither "ride up" on the wearer when he is alternately bending and striaghtening up, as for example when loading goods from the floor onto an uper shelf, nor "ride down" on the wearer when he is moving to and fro in an upright position.

The passage 29 has a substantially rectangular cross-section within the hem 30 and extends arcuately near the edge of each arm cut-out. The reinforcing seams 22 and 23 each have a radius R in the range from 25 cm to 40 cm, and the arm cut-out members and the body member are blanked so that, when the seams 22 and 23 are formed, the seams have the specified radius R. A radius substantially less than 25 cm causes the tape 14 to bind unacceptably, and also causes a poor fit for large-bodied wearers. A radius substantially greater than 40 cm permits the apron to ride down and also to cause the area 18 to become gathered and bunched, which is not only unsightly but also causes stress creases to develop in the vinyl surface over a period of time. Also, a larger radius than 40 cm allows sufficient movement of the apron on the tape, during routine bending movements of the wearer, that the lower edge of the tape 14 rubs against the second top-stitch 26 which then deteriorates. From the foregoing it will now be evident that a preselected radius R in the specified range permits an arcuate passage in which the tape has precisely the desired frictional engagement to fulfil the most exacting requirements of an expanded vinyl material which has qualities which are most desirable but difficult to maintain over a long period of time, because punctured vinyl, and stress-creased vinyl, tears so easily.

It will now be apparent that the top, bottom and side edges of the apron are desirably "finished", since an unfinished edge is easily damaged and moveover, looks unsightly. Thus, prior to sewing on the arm cut-out strips 12 and 13 to the body member 11, each of the sides 32 and 33, bottom edge 34, top edge 35 and bottom corners 36 and 37, are folded back on to the body member and stitched. The top edge 34 is folded over with a relatively wider portion than the other edges to provide additional reinforcement near the neck, and to further ensure the prevention of the stress creases near the area where the neck loop enters the hems.

I claim:

1. An adjustable apron to fit a person chosen from a wide range of body shapes and sizes, said apron comprising, (a) a body member of soft, flexible vinyl laminate of poly(vinyl chloride) bonded to a woven cotton fabric, (b) two separate identical quarter-ring-shaped arm cut-out strips of said vinyl laminate, (c) a single flat continuous tape snugly and slidably held in said apron so as to be frictionally engaged therein for arcuate movement only upon exertion of a force, said tape forming an adjustable neck loop and waist-tying ends, (d) two arcuate hems to permit support of said apron on the person's pelvic region, each hem being formed by sewing one of said arm cut-out strips to said body member on opposite sides thereof, said hem including (i) an arcuate hidden reinforcing seam having a radius from about 25 cm to about 40 cm, said seam being formed with a first top-stitch which compresses vinyl surfaces of said body member and an arm cut-out strip in abutting relationship between their woven cotton fabric surfaces so as to hinder propagation of punctures caused by said first top-stitch, (ii) a second top-stitch fastening said body member and said arm cut-out strip and compressing their cotton fabric surfaces in abutting relationship between their vinyl surfaces, and (iii) a third top-stitch which secures said hidden reinforcing seam tightly between said arm cut-out strip and said body member, so as to form (iv) an edge-rubbing surface against which the upper edge of said tape rubs when the apron is adjusted for use, and against which edge-rubbing surface the tape is stressed when the apron is in use, whereby, the apron is fixedly removably secured on the body of its wearer by tying a knot in said waist-tying ends so as to tension said tape without forming stress creases in said body member in the areas where said tape exits said hems.

* * * * *